United States Patent [19]

Jo et al.

[11] Patent Number: 5,039,363

[45] Date of Patent: Aug. 13, 1991

[54] PROCESS FOR PHOSPHATING METAL SURFACES

[75] Inventors: Masahiro Jo, Osaka; Yasutake Mino, Hyogo; Takamasa Shimizu, Nara; Koetsu Endo, Kyoto; Akio Tokuyama; Tamotsu Sobata, both of Osaka, all of Japan

[73] Assignee: Nippon Paint Co., Ltd., Osaka, Japan

[21] Appl. No.: 532,241

[22] Filed: May 30, 1990

Related U.S. Application Data

[63] Continuation of Ser. No. 286,122, Dec. 19, 1988, abandoned.

[30] Foreign Application Priority Data

Dec. 18, 1987 [JP] Japan ..... 62-321737
Mar. 17, 1988 [JP] Japan ..... 63-65271

[51] Int. Cl.[5] ..... C23C 22/40; C23C 22/16
[52] U.S. Cl. ..... 148/260; 148/262
[58] Field of Search ..... 148/260, 262

[56] References Cited

U.S. PATENT DOCUMENTS

| | | | |
|---|---|---|---|
| 2,502,441 | 4/1950 | Dodd | 148/259 |
| 2,854,369 | 9/1958 | Kronstein | 148/248 |
| 3,261,723 | 7/1966 | Craig | 148/262 |
| 3,819,424 | 6/1974 | Russel | 148/262 |
| 4,264,378 | 4/1981 | Oppen | 148/262 |

FOREIGN PATENT DOCUMENTS

| | | | |
|---|---|---|---|
| 1133806 | 10/1982 | Canada | 148/262 |
| 757050 | 9/1956 | United Kingdom | 148/262 |

OTHER PUBLICATIONS

European Pat. Off. 0135622.

*Primary Examiner*—Sam Silverberg
*Attorney, Agent, or Firm*—Wenderoth, Lind & Ponack

[57] ABSTRACT

A process for phosphating the surfaces of iron-based metals, zinc-based metals or combination of such surfaces by treating the metal surfaces with an aqueous acidic zinc-phosphating solution comprising from about 0.1 to about 200 g/l of zinc ion, from about 5 to about 40 g/l of phosphate ion, from about 0.01 to 20.0 g/l as tungsten of soluble tungsten compound and a conversion coating accelerator. The metal surfaces thus phosphated with the solution are suitable for electrocoating.

9 Claims, No Drawings

PROCESS FOR PHOSPHATING METAL SURFACES

This application is a continuation of now abandoned application Ser. No. 286,122 filed on Dec. 19, 1988.

FIELD OF THE INVENTION

The present invention relates to a process for phosphating a metal surface with an aqueous acidic zinc-phosphating solution. More particularly, the invention concerns a process for forming a phosphate film suitable for electrocoating, especially for cationic electrocoating, which is excellent in adhesion and corrosion-resistance, even under severe conditions as hot brine dipping test and scab corrosion test, and is particularly applicable to metal surfaces which include an iron-based surface, a zinc-based surface and combination of such surfaces as in an automobile body.

BACKGROUND OF THE INVENTION

As the pre-treatment of metal for electrocoating, there has heretofor been adopted phosphating, which has been carried out by either one of spraying, dipping or combination of dipping and spraying means. The spray process is advantageous in that it can save the installation cost and improve the production efficiently. However, in case of articles of complicated shapes which have many pocket portions, there are problems such that there are areas to which direct spray of a phosphating solution is not feasible and areas with only poor qualities due to splashes of the phosphating solution. Whereas, the dip process is, though the installation cost is rather high, much preferable to spray process for the articles of complicated shapes, since it is able to form a uniform film.

However, in the heretofor proposed dip treatments, it is generally recognized that in order to get a phosphating film, said treatment must be carried out with a phosphating solution containing a high concentration of zinc ion (2 to 4 g/l) at a high temperature (60° to 90° C.) for a long period of time (3 to 10 minutes). The formed film has a large film weight (3 to 5 g/m$^2$) and because of poor adhesion, low corrosion resistance and inferior appearance, is not suitable as a base for electrocoating. In recent years, electrocoating compositions to be used in an automobile industry have been changing from of anion type to of cation type so as to assure a satisfactory rust-proof effect even under various environmental conditions. Different from anionic electrocoating compositions, cationic electrocoating compositions form a coating film as the result of liberation of an alcohol blocking the crosslinking agent therein on baking, and therefore, the coating film is greatly shrinked and a considerable force acts on the phosphate film provided thereunder. Thus, the phosphate film as a base for cationic electrocoating is required to have a sufficient strength tolerable to the said shrinkage.

Under the circumstances, Nippon Paint Co., Ltd of Osaka, Japan recently filed a patent application, Japanese Patent publication (unexamined) No. 107784/1980, on a phosphating method of treating iron-based metal surfaces which is particularly suitable for treating manufactured products having complicated surfaces, such as automobile bodies.

The above phosphating method is in use commercially in the automotive industry for pretreating automobile bodies prior to cationic electrocoating. This method is carried out by first subjecting the metal surface to a dipping treatment with an aqueous acidic solution containing 0.5 to 1.5 g/l of zinc ion, 5 to 30g/l of phosphate ion, and 0.01 to 0.2 g/l of nitrite ion at a bath temperature of 40° to 70° C. for 15 to 120 seconds, followed by spraying with the above solution for 2 ~ 60 seconds for sludge removing purpose, and is reported to be capable of providing a phosphate film of relatively low film weight (1.5 to 3 g/m$^2$) which is effective for forming a coating by cationic electrocoating having excellent adhesion and corrosion-resistance on complicated articles.

Recently, in the automotive industry, consistent with the aim of further improving corrosion-resistance after the application of a siccative coating, steel components which are plated on one surface with zinc or a zinc alloy have come to be used as materials for automobile bodies. When the process of the above Japanese Patent publication is applied to such materials (i.e. to metal components having both iron-based metal surfaces and zinc-based metal surfaces), the iron-based surfaces are provided with a phosphate coating film having a low film thickness with uniform and dense cube crystals, as well as excellent adhesion and corrosion-resistance. Such phosphate coating on the iron-based surface is suitable as a substrate for cationic electrocoating. However, in the case of the phosphate coating film formed on the zinc-based surfaces, the resistance to salt spraying after the application of a cationic electrocoat thereto is insufficient, and secondary adhesion (by immersion test of the film with cross-hatched scratches in warm water) after cationic electrocoating—intermediate intermediate coating—top coating is greatly inferior to that on the iron-based surfaces.

To cope with the same, were provide, in Japanese Patent publication ((unexamined) No. 152472/1982), a technique of using an aqueous acidic phosphating solution comprising from 0.5 to 1.5 g/l of zinc ion, from 5 to 30 g/l of phosphate ion, from 0.6 to 3 g/l of manganese ion, and/or 0.1 to 4 g/l of nickel ion and a phosphating accelerator, and in Japanese Patent publication No. 36588/1986, a technique of using the combination of manganese ion and a fluoride ion in a phosphating solution.

By these methods, a phosphate coating film which is suitable for cationic electrocoating can be formed on iron-based metal surfaces, zinc-based metal surfaces or combination of these surfaces by dip treatment with an aqueous acidic phosphating solution and such dip treatment has acquired a firm, advantageous position in the phosphating processes for the purpose of improving corrosion-resistance of various kinds of metals including iron, zinc and alloy metals, for automobile bodies and parts, building materials and other small articles. Recently, with the increasing demand for quality cars, a far better anti-corrosive nature is longed for on the phosphate coating film. The film should preferably be well resistive toward hot brine dipping test and scab corrosion test. Unfortunately, the heretofor proposed phosphating processes have failed to meet the present quality requirements.

On the other hand, in the case of steel furnitures or the similar products, the spray process is still in the main current. However, even in that field, galvanized steel is getting increased in consumption and improvements in adhesion and corrosion-resistance, and especially scab corrosion resistance and hot brine dipping resistance are highly desired, it is an object of the present invention to provide a process for phosphating metal surfaces including iron-based surfaces, zinc-based surfaces and combination of these surfaces, resulting a phosphate film capable of providing excellent adhesion and corrosion-resistance to coatings from electrocoating and especially from cationic electrocoating.

A further object of the invention is to provide a process for phosphating metal surfaces, whereby the scab resistance of iron-based surface and hot brine dipping resistance of both iron-based and zinc-based surfaces after the application of a cationic electrocoat thereonto are greatly improved and secondary adhesion after cationic electrocoating, intermediate coating and top coating is likewise further improved.

A further object of the invention is to provide an aqueous acidic zinc-phosphating solution to be used in the present phosphating process.

An additional object of the invention is to provide an aqueous concentrated composition for formulating said aqueous acidic phosphating solution. An additional object of the invention is to provide phosphated metal surfaces obtained by the process of this invention. Other objects and advantages of the present invention will become apparent from the following disclosure.

According to the invention, the abovementioned objects can be attained with a process for treating a metal surface with an aqueous acidic zinc-phosphating solution comprising about from 0.01 to about 200 g/l as tungsten of soluble tungsten compound, and preferably, an aqueous acidic zinc-phosphating solution containing as essential components, from about 0.1 to about 2.0 g/l of zinc ion, from about 5 to about 40 g/l of phosphate ion, from about 0.01 to about 20.0 g/l as tungsten of soluble tungsten compound and a conversion coating accelerator.

The metal surfaces treated in accordance with the present invention include iron-based surfaces, zinc-based surfaces and combination of these surfaces. The term "treatment" as used in the present invention shall mean dipping, spraying or combination thereof. However, since there are miner variations in the details of such treatments and compositions of aqueous acidic zinc-phosphating solution used, the invention shall be now more fully explained separately for each treatment.

(I) Dipping treatment

In this mode of treatment, the metal surfaces are first degreased and washed with water and then, preferably, treated with a surface conditioner by spraying and/or dipping means, prior to the application of an aqueous acidic zinc-phosphating solution. The phosphating solution used in the dip treatment contains, as already stated, zinc ion, phosphate ion, soluble tungsten compound and a conversion coating accelerator as essential components.

Among them, the amount of zinc ion is determined in a range of about 0.1 to 2.0 g/l, and preferably from about 0.3 to about 1.5 g/l. When the amount of zinc ion is less than about 0.1 g/l, an even phosphate film is not formed on an iron-based surface, and a partially blue-colored, uneven film is formed. When the amount of zinc ion exceeds over about 2.0 g/l, then an even phosphate film is indeed formed, but the formed film is liable to be easily dissolved in an alkali and especially under alkaline atmosphere exposed at a cationic electrocoating. As the result, there is a marked decrease in hot brine dipping resistance and in case of an iron-based surface, scab resistance. Therefore, the treated metals are unsuitable as substrates for electrocoating and especially cationic electrocoating. The amount of phosphate ion in the solution is between about 5 to about 40 g/l, and preferably about 10 to about 30 g/l. When the amount of phosphate ion in the solution is less than about 5 g/l, an uneven film results. When the amount of phosphate ion exceeds about 40 g/l, no further improvement in the phosphate film is realized and hence, while not harmful, use of phosphate ion above about 40 g/l is uneconomical. The soluble tungsten compound is contained in the solution in an amount of about 0.01 to about 20.0 g/l as tungsten, preferably about 0.05 to 10.0 g/l as tungsten. When the amount of soluble tungsten compound in the solution is less than about 0.01 g/l as tungsten, property modification of phosphate film is not sufficient enough to the mark and no improvement in scab corrosion resistance and hot brine dipping resistance can be expected therewith. When the amount of soluble tungsten compound in the solution exceeds about 20.0 g/l as tungsten, there is no additional improvement in the properties of the formed phosphate film and occurs sludge in the solution, which is not desired. As a conversion coating accelerator, there may be used nitrite ion in a concentration of about 0.01 to about 0.5 g/l, preferably of about 0.01 to about 0.4 g/l, and/or m-nitrobenzenesulfonate ion in a concentration of about 0.05 to about 5 g/l, preferably of about 0.1 to about 4 g/l and/or hydrogen peroxide in a concentration (based on 100% $H_2O_2$) of about 0.5 to about 10 g/l, preferably of about 1 to about 8 g/l.

If the amounts of such accelerators in the solution are less than the defined lower limits, sufficient phosphating cannot be attained and yellow rust or the like may be formed on an iron-based surface, and if the amounts exceed the upper limits, an uneven film of blue color tends to be formed.

The source of zinc ion can be a soluble zinc-containing compound as, for example, zinc oxide, zinc carbonate and zinc nitrate. The source of phosphate ion can be such soluble compound as phosphoric acid, sodium phosphate, zinc phosphate and manganese phosphate. Examples of soluble tungsten compounds are tungstates as sodium tungstate and ammounium tungstate, and silicotungstic acid and silicotungstates as alkali metal silicotungstates, ammonium silicotungstate borotungstic acid, and phosphorus wolframate etc and alkali earth metal silicotungstates. Among them, particular preference in given to silicotungstic acid and silicotungstates. Examples of conversion coating accelerators are sodium nitrite, ammonium nitrite, sodium m-nitrobenzenesulfonate and hydrogen peroxide.

By the adoption of dip treatment with such aqueous acidic zinc-phosphating solution, it is able to give on a metal surface including iron-based surface, zinc-based surface and combination of these surfaces, a phosphate coating which is suitable for electrocoating and is excellent in corrosion-resistance, and especially scab corrosion resistance and resistance to hot brine dipping test as well as coat adhesion properties.

With respect to the optional ingredients that can be added to the aqueous acidic solution of the invention, manganese ion, nickel ion and/or fluoride ion is/are useful in strengthening the effects of soluble tungsten compound synergistically.

When employed, the amount of manganese ion is between about 0.1 to 3 g/l, preferably of about 0.6 to about 3 g/l. If the amount of manganese ion is less than about 0.1 g/l, the synergistic effects with the combination with a soluble tungsten compound, i.e. synergistic improvements in adhesion and hot brine dipping resistance, can not be attained. When the amount of manganese ion exceeds the upper limit of about 3 g/l, then there is a tendency that the desired scab resistance be lowered.

The amount of nickel ion in the solution should preferably be limited in a range of about 0.1 to about 4 g/l, and more preferably about 0.1 to about 2 g/l. This is because, when the amount of nickel ion is less than about 0.1 g/l, the synergistic effect in the improvement in the scab resistance with a soluble tungsten compound can not be attained, and when the amount of nickel ion exceeds about 4 g/l in the solution, there is a tendency that hot brine dipping resistance be lowered.

The amount of fluoride ion, if employed, should preferably be limited in a range of about 0.05 to about 4 g/l, and more preferably about 0.1 to about 2 g/l. When the amount of fluoride ion is less than the lower limit of about 0.05 g/l, it is unable to expect the desired synergistic effect in the improvement in scab resistance with a soluble tungsten compound, and when the amount of fluoride ion exceeds about 4 g/l, there is a tendency that the hot brine dipping resistance be lowered.

The aqueous acidic solutions of the invention may further contain about 0.1 to about 15 g/l, preferably about 2 to about 10 g/l, of nitrate ion and/or about 0.05 to less than about 2.0g/l, preferably about 0.2 to about 1.5 g/l, of chlorate ion.

As an example of a source of manganese ions, one or more of the following can be used: manganese carbonate, manganese nitrate, manganese chloride, and manganese phosphate.

As an example of a source of nickel ions, one or more of the following can be used: nickel carbonate, nickel nitrate, nickel chloride, nickel phosphate, and nickel hydroxide.

As an example of a source of fluoride ions, one or more of the following can be employed: hydrofluoric acid, borofluoric acid, hydrosilicofluoric acid, and their metal salts.

As a source of nitrate ions, sodium nitrate, ammonium nitrate, zinc nitrate, manganese nitrate, nickel nitrate and the like are used, and as a source of chlorate ions, sodium chlorate, ammounium chlorate, etc are used.

The present process is carried out at a temperature in the range of about 30° to about 70° C., preferably about 35° to about 60° C. When the temperature is lower than about 30° C., the conversion coating deteriorates, and long treating time is required to obtain a satisfactory coating. When the temperature is higher than about 70° C., the conversion coating accelerators begin to decompose at an unacceptable rate, leading to precipitation in the coating composition and making the composition unbalanced. This can lead to the formation of poor coatings.

The period of dipping treatment is at least 15 seconds, preferably about 30 to about 120 seconds. When the treatment is shorter than the abovementioned treatment period, it is unable to get an adequate phosphate film with the desired crystalline form. In treating metal components having complicated surface profiles, such as with car bodies, the components can be subjected first to dipping treatment for about 15 seconds or more, preferably about 30 to about 120 seconds, and then to spray treatment with the same aqueous solution for about 2 seconds or more, preferably about 5 to about 45 seconds. In order to wash out the sludge adhered on the components during dipping, the post-spray treatment is preferably carried out for as long a period with the abovementioned range as the speed of the production line will permit. Accordingly, the dipping treatment according to the present invention includes the combination of dipping followed by spraying.

The present process may be carried out by spray treatment alone.

(II) Spray treatment

The present process may be carried out by spray treatment alone.

At this time, the aqueous acidic phosphating solution may advantageously be modified as follows:

zinc ion concentration is limited to a more narrow range of about 0.4 to about 1.2 g/l and chlorate ion is added as essential component in an amount of about 2.0 to about 5.0 g/l.

According to a preferred embodiment of the present invention, is used an aqueous acidic zinc-phosphating solution of the following composition in spray treatment:

about 0.4 to about 1.2 g/l of zinc ion, about 5 to about 40 g/l of phosphate ion, about 0.01 to about 20.0 g/l as tungsten of a soluble tungsten compound, about 2.0 to about 5.0 g/l of chlorate ion and a conversion coating accelerator.

The metal surfaces are first degreased, washed with water and then directly sprayed with the abovementioned solution at about 30°~70° C. for about 1 to 3 minutes under spray pressure of 0.5~2.0 kg,/cm$^2$. This treated metal surfaces are washed with tap water and then with a deionized water and dried.

The amount of zinc ion in the solution for spray treatment is limited in a range of about 0.4 to about 1.2 g/l, preferably about 0.5 to about 0.9 g/l. This is because, when the amount of zinc ion in the solution is less than about 0.4 g/l, there tends to be formed coatings which are not uniform in that they consist partially of blue iron phosphate coatings, and when the amount of zinc ion exceeds about 1.2 g/l, there indeed produce uniform zinc phosphate coatings, but thus formed coatings tend to possess a leaf-like crystal structure, which are not suitable as undercoats for cationic electrodeposition in that adhesive and corrosion-resistant properties are not as good as desired.

The phosphate ion content is limited in a range of about 5 to about 40 g/l, preferably about 10 to about 20 g/l. When the content of phosphate ion is less than about 5 g/l, an uneven phosphate film is apt to be formed and the aqueous phosphating solution is liable to become an unbalanced composition. When the phosphate ion content is more than about 40 g/l, no further benefits result, and it is therefore economically disadvantageous to use additional quantities of phosphate chemicals over the abovementioned upper limit. In the spray treatment, it is essential that appropriate amounts of chlorate ions, i.e. about 2.0 to about 5.0 g/l, preferably about 2.5 to about 4.0 g/l, be present in the aqueous acidic phosphating solution.

When the amount of chlorate ion in the solution is less than about 2.0 g/l, though a uniform and good coating film is formed, thus formed coating tends to possess a leaf-like crystal structure and such coating is improper as an undercoat for cationic electrodeposition, having only poor adhesive and corrosion-resistant properties. When the amount of chlorate ion exceeds about 5.0 g/l, such a solution tends to lead to the formation of non-uniform zinc phosphate coatings which include blue iron phosphate coatings and have only poor corrosion-resistant properties.

The soluble tungsten compound should be contained in the solution in an amount of about 0.01 to about 20.0 g/l as tungsten, and preferably about 0.05 to about 10.0 g/l and most preferably about 0.1 to about 3.0 g/l as tungsten. If the amount of soluble tungsten compound is less than the abovementioned lower limit, the desired modification of phosphate coating, i.e. improvement in scab corrosion resistance and hot brine dipping resistance can not be fully attained.

Whereas, when the amount of soluble tungsten compount expressed in terms of tungsten exceeds about 20.0 g/l, no further improvements can be attained and undesirably amounts of sludge are formed, which is not desired. As a conversion coating accelerator, one or more of the following are used:

from about 0.01 to about 0.5 g/l, preferably about 0.04 to about 0.4 g/l, of nitrite ion; from about 0.05 to about 5 g/l, preferably about 0.1 to about 4 g/l of m-nitrobenzene sulfonate ion; and from about 0.5 to about 10 g/l, preferably about 1 to about 8 g/l of hydrogen peroxide (calculated as 100% $H_2O_2$).

When conversion coating accelerator is present in less than the amounts given above, a sufficient quantity of phosphate coating is not formed on the iron-based surfaces, giving rise to yellow rust and other defects. On the other hand, when the accelerator content is greater than the amount given above, a blue colored uneven film is Besides the above, the present aqueous acidic phosphating solution to be used in spray treatment may further contain, as already mentioned in connection with the solution to be used in dipping treatment, manganese ion and/or nickel for the additional improvement in adhesive and corrosion-resistant properties, fluoride ion for the improvement in the phosphate coating, and nitrate ion for the improvement in storage stability.

By the adoption of spray treatment with the abovementioned aqueous acidic phosphating solution, it is possible to obtain, in an economic manner, a fine, even and dense phosphate film (low coating weight: 1.0 to 1.8 g/m$^2$) which provides excellent adhesion and corrosion-resistance to coatings formed by cationic electrocoating, and which is specifically excellent in scab resistance, hot brine dipping resistance, and adhesion especially on zinc-based surface.

The present invention further provides a concentrated aqueous composition in 2 packs' form for formulating the aqueous acidic zinc-phosphating solutions of the present invention.

The aqueous acidic phosphating solutions are conveniently prepared by mixing the contents of said two packs, diluting thus obtained aqueous concentrate which contains a number of the solution ingredients in proper weight ratios, and then adding other ingredients as needed to prepare the phosphating solutions of the invention. The concentrates are usually composed of (A) pack containing source of zinc ion, source of phosphate ion and soluble tungsten compound, in a weight proportion of zinc ion : phosphate ion : tungsten of 1:2.5~400:0.005~200, and (B) pack containing a conversion coating accelerator. If desired, sources of other ions as manganese ion, nickel ion, fluoride ion, nitrate ion and/or chlorate ion may be added to said (A) pack. Among them, chlorate ions may be added to (B) pack in place of (A) pack. When manganese ions are added to (A) pack, said chlorate ions should preferably be added to (B).

The present concentrated aqueous compositions may also be composed of (A) pack containing the source of zinc ion, source of phosphate ion and sources of other optional ions, and (B) pack containing soluble tungsten compound and conversion coating accelerator.

The phosphate coatings thus formed on metal surfaces by the practice of this invention do surely contain an amount of tungsten when tungstates are used as soluble tungsten compound. When silicotungstic acid and/or silicotungstates are used as the source of soluble tungsten compound, thus formed coatings do not contain tungsten and however, there always results an increased coating weight. In either case, thus formed coatings are excellent in adhesion, corrosion-resistance and especially scab-corrosion resistance and hot brine dipping resistance. Therefore, in this invention, are provided metal materials having phosphate coatings with the abovementioned properties thereon.

The invention shall be now more fully explained in the following Examples. Unless otherwise being stated, all parts and percentages are by weight.

EXAMPLES 1~32

Examples 1~18 are examples of the process and composition of the invention. Examples 19~32 are examples using known compositions, given for comparison purposes.

The treating process used, which is common to all examples, is given below, with the aqueous acidic zinc-phosphating solutions of each example set forth in Table 1, while the metals treated and the test results obtained following the phosphate treatment are given in Table 2.

(1) Metal to be subjected to treatment hot dipped zinc alloy plated steel plate,
electro galvanized steel plate,
electro zinc-alloy plated steel plate,
cold rolled steel plate.

(2) Treating process

Samples of all four metal surfaces given in Table 2 were treated simultaneously according to the following procedures.

Degreasing→water washing→surface conditioning→phosphating by dipping→water washing→deionized water washing→drying→coating or Degreasing→water washing→phosphating by spraying→water washing→deionized water washing→drying→coating (3) Treating conditions (a) Degreasing Using an alkaline degreasing agent ("RIDOLINE SD 250" made by Nippon Paint Co., 2 wt % concentration), dip treatment was carried out at 40° C. for 2 minutes, for Examples wherein dip treatment was used in phosphating step.

In other Examples wherein spray treatment was used in phosphating step, an alkaline degreasing agent ("RIDOLINE S 102" made by Nippon Paint Co., 2 wt % concentration) was applied by spraying at 50° C. for 2 minutes.

(b) washing with water

Using tap water, washing was carried out at room temperature for 15 seconds.

(c) Surface conditioning

This treatment was adopted only for the Examples wherein dip treatment was used in phosphating step.

Using a surface conditioning agent ("FIXODINE 5N-5" made by Nippon Paint Co., 0.1 wt % concentration), dip treatment was made at room temperature for 15 seconds.

(d) Phosphating

Using the aqueous acidic zinc-phosphating solutions given in Table 1, dip treatment was carried out at the temperature indicated in Table 1 for 120 seconds or spray treatment was carried out at the temperature and under the pressure each indicated in Table 1 for 120 seconds.

(e) water washing

Using tap water, washing was carried out at room temperature for 15 seconds.

(f) Deionized water washing

Using deionized water, dip treatment was effected at room temperature for 15 seconds.

(g) Drying

Drying was carried out with hot air at 100° C. for 10 minutes. The weight of each phosphate film thus obtained was determined.

(h) Coating

A cationic electrocoating composition ("POWER TOP U-80 Grey" made by Nippon Paint Co.,) was coated to a dry film thickness of 20μ (voltage 180V, electricity applying times 3 minutes), and the surface was baked at 180° C. for 30 minutes. A part of thus obtained electrocoated plates were used for the hot brine dipping test hereinunder mentioned. The remaining non-tested electrocoated plates were coated with an intermediate coating composition ("ORGA TO 4811 Grey" made by Nippon Paint Co., melamine-alkyd resin base coating composition) to a dry film thickness of 3μ by spraying means, and the surfaces were baked at 140° C. for 20 minutes.

Then, they were coated with a top coating composition ("ORGA TO 630 Dover White" made by Nippon Paint Co., melamine-alkyd resin base coating composition) to a dry film thickness of 40μ by spraying means, and the surfaces were baked at 140° C. for 20 minutes, to obtain coated plates having a total of 3-coatings and 3-bakings, which were then subjected to adhesion test and scab corrosion test.

(4) Test results

The results are shown in Table 2. Each test method is shown below.

(a) Hot brine dipping test Cross cuts were made on the electrocoated plate, which was then dipped in a 5% brine (55° C.) for 480 hours. An adhesive tape was applied on the cut portion and then peeled off. The maximum width of the peeled coating was determined.

(b) Adhesion test

The coated plate was dipped in deionized water at 40° C. for 20 days, after which it was provided with grids (100 squares each) made at 1 mm intervals and at 2 mm intervals using a sharp cutter. To each surface of the thus treated plate, an adhesive tape was applied, after which it was peeled off and the number of the remaining coated squares on the coated plate wad counted.

(e) Scab corrosion test

Cross cuts were made on the coated plate, which was then subjected to 10 cycles' anti-corrosion test, each cycle consisting of a brine spray test (JIS-Z-2371, 24 hours)→ a humidity test (temperature 40° C., relative humidity 85%, 120 hours)→followed by standing in a room (for 24 hours). After the test, the maximum width of the corroded portions on the coated surface was determined. The test used is herein called as scab corrosion test.

TABLE 1

| | | Example | | | | | | | | | | | |
|---|---|---|---|---|---|---|---|---|---|---|---|---|---|
| | | 1 | 2 | 3 | 4 | 5 | 6 | 7 | 8 | 9 | 10 | 11 | 12 |
| Composition of acidic aq. phosphate solution | Zn ion (g/l) | 0.8 | 1.0 | 1.0 | 1.0 | 1.0 | 1.0 | 1.0 | 0.4 | 0.4 | 1.0 | 0.8 | 1.0 |
| | $PO_4$ ion (g/l) | 14.0 | 14.0 | 14.0 | 14.0 | 14.0 | 14.0 | 14.0 | 14.5 | 14.5 | 14.5 | 14.0 | 14.0 |
| | Mn ion (g/l) | | | 0.8 | 0.8 | 0.8 | 0.8 | 0.4 | | | | | 0.8 |
| | Ni ion (g/l) | | 0.5 | | 0.8 | | 0.8 | 0.4 | 0.5 | 0.5 | 0.5 | | 0.8 |
| | W (g/l) | 2.0 | 1.0 | 0.5 | 0.3 | 0.5 | 0.1 | 1.0 | 0.2 | 0.2 | 9.0 | 0.2 | 0.1 |
| | F ion (g/l) | | | | | 1.0 | 1.0 | 1.0 | | | | | 1.0 |
| | $NO_2$ ion (g/l) | 0.15 | 0.15 | 0.15 | 0.15 | 0.15 | 0.12 | 0.18 | 0.1 | 0.1 | 0.25 | 0.15 | 0.12 |
| | $NO_3$ ion (g/l) | 3.0 | 3.0 | 4.0 | 4.0 | 4.0 | 4.0 | 4.0 | 7.0 | 7.0 | 3.0 | 3.0 | 4.0 |
| | $ClO_3$ ion (g/l) | 0.5 | 0.5 | 0.7 | 0.7 | 0.3 | | | | 0.3 | | 0.5 | |
| Total acidity (point) | | 17.2 | 17.6 | 17.8 | 18.6 | 21.3 | 22.1 | 21.5 | 16.5 | 16.5 | 20.5 | 17.2 | 22.1 |
| Free acidity (point) | | 0.9 | 0.9 | 0.9 | 0.9 | 0.9 | 0.9 | 0.9 | 0.2 | 0.2 | 0.9 | 0.9 | 0.9 |
| treating temp. (°C.) | | 52 | 52 | 52 | 52 | 40 | 40 | 40 | 55 | 55 | 52 | 52 | 40 |
| treatment method | | Dip | Dip | Dip | Dip | Dip | Dip | Dip | Spray | Spray | Dip | Dip | Dip |
| Spraying pressure (kg/cm²) | | — | — | — | — | — | — | — | 0.8 | 0.8 | — | — | — |

| | | Example | | | | | | | | | |
|---|---|---|---|---|---|---|---|---|---|---|---|
| | | 13 | 14 | 15 | 16 | 17 | 18 | 19 | 20 | 21 | 22 |
| Composition of acidic aq. phosphate solution | Zn ion (g/l) | 0.6 | 0.6 | 0.6 | 0.6 | 0.6 | 0.6 | 0.8 | 1.0 | 1.0 | 1.0 |
| | $PO_4$ ion (g/l) | 14.5 | 14.5 | 14.5 | 14.5 | 14.5 | 14.5 | 14.0 | 14.0 | 14.0 | 14.0 |
| | Mn ion (g/l) | | | 0.8 | 0.4 | 0.4 | | | | 0.8 | 0.8 |
| | Ni ion (g/l) | | 0.8 | | 0.4 | 0.4 | 0.8 | | 0.5 | | 0.8 |
| | W (g/l) | 2.0 | 0.2 | 0.1 | 0.3 | 0.3 | 9.0 | | | | |
| | F ion (g/l) | | | | 1.0 | | | | | | |
| | $NO_2$ ion (g/l) | 0.2 | 0.1 | 0.1 | 0.1 | 0.08 | 0.25 | 0.06 | 0.06 | 0.06 | 0.06 |
| | $NO_3$ ion (g/l) | 5.0 | 5.0 | 5.0 | 5.0 | 5.0 | 5.0 | 3.0 | 4.0 | 4.0 | 4.0 |
| | $ClO_3$ ion (g/l) | 2.6 | 2.6 | 2.6 | 2.6 | 3.5 | 2.6 | 0.5 | 0.5 | 0.7 | 0.7 |
| Total acidity (point) | | 17.2 | 17.5 | 17.5 | 21.0 | 17.5 | 20.6 | 16.5 | 17.0 | 17.6 | 18.5 |
| Free acidity (point) | | 0.6 | 0.6 | 0.6 | 0.6 | 0.6 | 0.6 | 0.9 | 0.9 | 0.9 | 0.9 |
| treating temp. (°C.) | | 55 | 55 | 55 | 55 | 55 | 55 | 52 | 52 | 52 | 52 |
| treatment method | | Spray | Spray | Spray | Spray | Spray | Spray | Dip | Dip | Dip | Dip |
| Spraying pressure (kg/cm²) | | — | 0.8 | 0.8 | 0.8 | 0.8 | 0.8 | — | — | — | — |

| | Example | | | | | | | | | |
|---|---|---|---|---|---|---|---|---|---|---|
| | 23 | 24 | 25 | 26 | 27 | 28 | 29 | 30 | 31 | 32 |

TABLE 1-continued

| | | | | | | | | | | | |
|---|---|---|---|---|---|---|---|---|---|---|---|
| Composition of acidic aq. phosphate solution | Zn ion (g/l) | 1.0 | 1.0 | 1.0 | 0.4 | 0.4 | 0.6 | 0.6 | 0.6 | 0.6 | 0.6 |
| | $PO_4$ ion (g/l) | 14.0 | 14.0 | 14.0 | 14.5 | 14.5 | 14.5 | 14.5 | 14.5 | 14.5 | 14.5 |
| | Mn ion (g/l) | 0.8 | 0.8 | 0.4 | | | | | 0.8 | 0.4 | 0.4 |
| | Ni ion (g/l) | | 0.8 | 0.4 | 0.5 | 0.5 | | 0.8 | | 0.4 | 0.4 |
| | W (g/l) | | | | | | | | | | |
| | F ion (g/l) | 1.0 | 1.0 | 1.0 | | | | | | 1.0 | |
| | $NO_2$ ion (g/l) | 0.06 | 0.12 | 0.12 | 0.1 | 0.1 | 0.1 | 0.1 | 0.1 | 0.1 | 0.08 |
| | $NO_3$ ion (g/l) | 4.0 | 4.0 | 4.0 | 7.0 | 7.0 | 5.0 | 5.0 | 5.0 | 5.0 | 5.0 |
| | $ClO_3$ ion (g/l) | 0.3 | | | | 0.3 | 2.6 | 2.6 | 2.6 | 2.6 | 3.5 |
| Total acidity (point) | | 21.1 | 22.0 | 21.1 | 16.4 | 16.4 | 16.5 | 17.4 | 17.4 | 20.9 | 17.4 |
| Free acidity (point) | | 0.9 | 0.9 | 0.9 | 0.2 | 0.2 | 0.6 | 0.6 | 0.6 | 0.6 | 0.6 |
| treating temp. (°C.) | | 40 | 40 | 40 | 55 | 55 | 55 | 55 | 55 | 55 | 55 |
| treatment method | | Dip | Dip | Dip | Spray | Spray | Spray | Spray | Spray | Spray | Spray |
| Spraying pressure ($kg/cm^2$) | | — | — | — | 0.8 | 0.8 | 0.8 | 0.8 | 0.8 | 0.8 | 0.8 |

TABLE 2

| Metal | test items | Example 1 | 2 | 3 | 4 | 5 | 6 | 7 | 8 |
|---|---|---|---|---|---|---|---|---|---|
| Hot dipped zinc alloy plated steel plate | film weight ($g/m^2$) | 4.7 | 4.4 | 4.0 | 3.4 | 3.2 | 3.3 | 3.4 | 3.70 |
| | adhesion | | | | | | | | |
| | 2 mm | 100/100 | 100/100 | 100/100 | 100/100 | 100/100 | 100/100 | 100/100 | 100/100 |
| | 1 mm | 100/100 | 100/100 | 100/100 | 100/100 | 100/100 | 100/100 | 100/100 | 92/100 |
| | Hot brine dip. (mm) | 3.0 | 2.5 | 2.5 | 2.0 | 1.5 | 1.0 | 1.0 | 3.0 |
| Electro galvanized steel plate | film weight ($g/m^2$) | 3.5 | 3.3 | 3.2 | 2.5 | 2.4 | 2.5 | 2.5 | 3.30 |
| | adhesion | | | | | | | | |
| | 2 mm | 100/100 | 100/100 | 100/100 | 100/100 | 100/100 | 100/100 | 100/100 | 100/100 |
| | 1 mm | 89/100 | 94/100 | 100/100 | 100/100 | 100/100 | 100/100 | 100/100 | 65/100 |
| | Hot brine dip. (mm) | 4.5 | 3.5 | 3.0 | 2.5 | 2.0 | 1.5 | 1.5 | 4.0 |
| Electro zinc-alloy plated steel plate | film weight ($g/m^2$) | 4.1 | 4.2 | 3.9 | 3.7 | 3.0 | 2.9 | 3.2 | 3.50 |
| | adhesion | | | | | | | | |
| | 2 mm | 100/100 | 100/100 | 100/100 | 100/100 | 100/100 | 100/100 | 100/100 | 100/100 |
| | 1 mm | 100/100 | 100/100 | 100/100 | 100/100 | 100/100 | 100/100 | 100/100 | 93/100 |
| | Hot brine dip. (mm) | 3.0 | 2.5 | 2.0 | 2.0 | 1.5 | 1.0 | 1.5 | 3.5 |
| Cold rolled steel plate | film weight ($g/m^2$) | 3.0 | 2.9 | 2.7 | 2.8 | 2.5 | 2.6 | 2.7 | 1.5 |
| | adhesion | | | | | | | | |
| | 2 mm | 100/100 | 100/100 | 100/100 | 100/100 | 100/100 | 100/100 | 100/100 | 100/100 |
| | 1 mm | 100/100 | 100/100 | 100/100 | 100/100 | 100/100 | 100/100 | 100/100 | 100/100 |
| | Hot brine dip. (mm) | 1.0 | 1.0 | 1.0 | 0.5 | 0.5 | 0 | 0 | 2.0 |
| | Scab corrosion (mm) | 6.0 mm | 5.5 mm | 4.0 mm | 3.5 mm | 3.5 mm | 3.0 mm | 3.0 mm | 7.0 mm |

| Metal | test items | Example 9 | 10 | 11 | 12 | 13 | 14 | 15 | 16 |
|---|---|---|---|---|---|---|---|---|---|
| Hot dipped zinc alloy plated steel plate | film weight ($g/m^2$) | 3.55 | 4.5 | 5.3 | 4.8 | 3.9 | 3.5 | 3.5 | 3.6 |
| | adhesion | | | | | | | | |
| | 2 mm | 100/100 | 100/100 | 100/100 | 100/100 | 100/100 | 89/100 | 100/100 | 100/100 |
| | 1 mm | 95/100 | 100/100 | 100/100 | 100/100 | 93/100 | 74/100 | 100/100 | 100/100 |
| | Hot brine dip. (mm) | 2.5 | 1.0 | 2.5 | 1.0 | 4.0 | 3.5 | 3.5 | 3.0 |
| Electro galvanized steel plate | film weight ($g/m^2$) | 3.30 | 3.4 | 4.0 | 3.1 | 3.3 | 3.1 | 3.1 | 3.1 |
| | adhesion | | | | | | | | |
| | 2 mm | 100/100 | 100/100 | 100/100 | 100/100 | 63/100 | 72/100 | 100/100 | 100/100 |
| | 1 mm | 75/100 | 98/100 | 92/100 | 100/100 | 39/100 | 59/100 | 100/100 | 100/100 |
| | Hot brine dip. (mm) | 4.0 | 1.5 | 3.5 | 1.5 | 5.0 | 4.5 | 4.0 | 4.0 |
| Electro zinc-alloy plated steel plate | film weight ($g/m^2$) | 3.30 | 4.2 | 4.5 | 3.8 | 3.8 | 3.5 | 3.6 | 3.5 |
| | adhesion | | | | | | | | |
| | 2 mm | 100/100 | 100/100 | 100/100 | 100/100 | 91/100 | 87/100 | 100/100 | 100/100 |
| | 1 mm | 98/100 | 100/100 | 100/100 | 100/100 | 85/100 | 75/100 | 100/100 | 100/100 |
| | Hot brine dip. (mm) | 3.0 | 2.0 | 2.5 | 1.0 | 4.0 | 4.0 | 3.5 | 3.0 |
| Cold rolled steel plate | film weight ($g/m^2$) | 1.5 | 3.0 | 3.5 | 3.2 | 1.6 | 1.4 | 1.5 | 1.3 |
| | adhesion | | | | | | | | |
| | 2 mm | 100/100 | 100/100 | 100/100 | 100/100 | 100/100 | 100/100 | 100/100 | 100/100 |
| | 1 mm | 100/100 | 100/100 | 100/100 | 100/100 | 100/100 | 100/100 | 100/100 | 100/100 |
| | Hot brine dip. (mm) | 1.5 | 0 | 0.5 | 0 | 1.5 | 1.5 | 1.0 | 1.0 |
| | Scab corrosion (mm) | 7.0 mm | 3.0 mm | 4.5 mm | 2.5 mm | 6.8 mm | 7.0 mm | 6.6 mm | 5.2 mm |

| Metal | test items | Example 17 | 18 | 19 | 20 | 21 | 22 | 23 | 24 |
|---|---|---|---|---|---|---|---|---|---|
| Hot dipped zinc alloy plated steel plate | film weight ($g/m^2$) | 3.6 | 4.0 | 4.6 | 4.1 | 3.8 | 3.2 | 2.9 | 3.1 |
| | adhesion | | | | | | | | |
| | 2 mm | 100/100 | 100/100 | 45/100 | 65/100 | 100/100 | 100/100 | 100/100 | 100/100 |
| | 1 mm | 100/100 | 100/100 | 0/100 | 0/100 | 100/100 | 100/100 | 100/100 | 100/100 |
| | Hot brine dip. (mm) | 3.0 | 2.0 | 6.0 | 5.5 | 4.5 | 3.5 | 3.0 | 2.5 |
| Electro galvanized steel plate | film weight ($g/m^2$) | 3.1 | 3.4 | 3.2 | 3.0 | 2.7 | 2.4 | 2.2 | 2.1 |
| | adhesion | | | | | | | | |
| | 2 mm | 100/100 | 100/100 | 0/100 | 23/100 | 100/100 | 100/100 | 100/100 | 100/100 |
| | 1 mm | 100/100 | 100/100 | 0/100 | 0/100 | 100/100 | 98/100 | 100/100 | 100/100 |
| | Hot brine dip. (mm) | 3.5 | 2.5 | 8.5 | 7.5 | 5.0 | 4.5 | 4.0 | 3.5 |
| Electro | film weight ($g/m^2$) | 3.5 | 3.9 | 4.2 | 3.8 | 3.6 | 3.4 | 2.8 | 2.7 |

TABLE 2-continued

| | | | | | | | | | |
|---|---|---|---|---|---|---|---|---|---|
| zinc-alloy | adhesion | | | | | | | | |
| plated | 2 mm | 100/100 | 100/100 | 32/100 | 43/100 | 100/100 | 100/100 | 100/100 | 100/100 |
| steel plate | 1 mm | 100/100 | 100/100 | 0/100 | 8/100 | 92/100 | 100/100 | 100/100 | 100/100 |
| | Hot brine dip. (mm) | 3.0 | 2.5 | 6.5 | 6.5 | 5.0 | 4.0 | 4.0 | 3.0 |
| Cold rolled | film weight (g/m$^2$) | 1.3 | 1.7 | 2.7 | 2.6 | 2.4 | 2.5 | 2.2 | 2.1 |
| steel plate | adhesion | | | | | | | | |
| | 2 mm | 100/100 | 100/100 | 100/100 | 100/100 | 100/100 | 100/100 | 100/100 | 100/100 |
| | 1 mm | 100/100 | 100/100 | 98/100 | 100/100 | 100/100 | 100/100 | 100/100 | 100/100 |
| | Hot brine dip. (mm) | 1.0 | 0.5 | 3.0 | 2.5 | 2.0 | 1.5 | 1.5 | 1.0 |
| | Scab corrosion (mm) | 4.9 mm | 4.3 mm | 12.0 mm | 10.0 mm | 7.5 mm | 6.5 mm | 6.0 mm | 4.5 mm |

| | | Example | | | | | | | |
|---|---|---|---|---|---|---|---|---|---|
| Metal | test items | 25 | 26 | 27 | 28 | 29 | 30 | 31 | 32 |
| Hot dipped zinc | film weight (g/m$^2$) | 3.0 | 3.50 | 3.40 | 3.8 | 3.3 | 3.4 | 3.3 | 3.3 |
| alloy plated | adhesion | | | | | | | | |
| steel plate | 2 mm | 84/100 | 40/100 | 50/100 | 0/100 | 65/100 | 100/100 | 100/100 | 100/100 |
| | 1 mm | 65/100 | 15/100 | 20/100 | 0/100 | 40/100 | 100/100 | 100/100 | 100/100 |
| | Hot brine dip. (mm) | 5.0 | 5.0 | 4.5 | 7.0 | 5.5 | 4.5 | 5.5 | 5.0 |
| Electro | film weight (g/m$^2$) | 2.1 | 3.10 | 3.10 | 3.2 | 3.0 | 3.1 | 3.1 | 3.1 |
| galvanized | adhesion | | | | | | | | |
| steel plate | 2 mm | 45/100 | 0/100 | 0/100 | 0/100 | 0/100 | 100/100 | 85/100 | 85/100 |
| | 1 mm | 0/100 | 0/100 | 0/100 | 0/100 | 0/100 | 100/100 | 65/100 | 60/100 |
| | Hot brine dip. (mm) | 6.5 | 5.5 | 5.3 | 8.5 | 6.0 | 5.5 | 6.0 | 6.0 |
| Electro | film weight (g/m$^2$) | 2.8 | 3.50 | 3.40 | 3.7 | 3.3 | 3.4 | 3.2 | 3.2 |
| zinc-alloy | adhesion | | | | | | | | |
| plated | 2 mm | 80/100 | 40/100 | 50/100 | 0/100 | 65/100 | 100/100 | 100/100 | 100/100 |
| steel plate | 1 mm | 58/100 | 20/100 | 25/100 | 0/100 | 45/100 | 100/100 | 100/100 | 100/100 |
| | Hot brine dip. (mm) | 6.0 | 5.0 | 4.4 | 7.5 | 5.5 | 5.5 | 5.5 | 5.0 |
| Cold rolled | film weight (g/m$^2$) | 2.2 | 1.4 | 1.4 | 1.5 | 1.3 | 1.4 | 1.3 | 1.3 |
| steel plate | adhesion | | | | | | | | |
| | 2 mm | 100/100 | 100/100 | 100/100 | 100/100 | 100/100 | 100/100 | 100/100 | 100/100 |
| | 1 mm | 100/100 | 100/100 | 100/100 | 100/100 | 100/100 | 100/100 | 100/100 | 100/100 |
| | Hot brine dip. (mm) | 2.5 | 4.0 | 3.5 | 3.5 | 2.5 | 2.5 | 2.5 | 2.2 |
| | Scab corrosion (mm) | 8.5 mm | 11.0 mm | 10.0 mm | 12.8 mm | 9.8 mm | 8.9 mm | 8.5 mm | 8.1 mm |

As the source of tungsten (W), ammonium tungstate was used on each of Examples 1~8, 10, 13~and 18;

sodium tungstate in Examples 9 and 17; and silicotungstic acid in Examples 11 and 12.

What is claimed is:

1. A process for zinc-phosphating a metal surface comprising contacting the metal surface with an aqueous acidic zinc phosphating solution consisting essentially of (a) from about 0.1 to about 2.0 g/l of zinc ions, (b) from about 5 to about 40 g/l of phosphate ions, (c) from about 0.01 to about 20.0 g/l as tungsten of at least one soluble tungsten compound selected from the group consisting of borotungstic acid, silicotungstic acid, alkali metal silicotungstate, ammonium silicotungstate and alkali earth metal silicotungstate, (d) at least one conversion coating accelerator selected form the group consisting of (1) from about 0.01 to about 0.5 g/l of nitride ions, (2) from about 0.05 to about 5.0 g/l of m-nitrobenzene sulfonate ions, and (3) from about 0.5 to about 10 g/l of hydrogen peroxide, and (e) at least one agent which synergistically enhance the effects of the soluble tungsten compound, selected from the group consisting of , (1) from about 0.1 to about 3 g/l of manganese ions, (2) from about 0.1 to about 4 g/l of nickel ions, (3) from about 0.05 to about 4 g/l of a fluoride ions, and (4 ) from about 0.1 to about 15 g/l of a nitrate ions.

2. A process according to claim 1 wherein said contact is carried out by dipping the metal surface in the aqueous acidic zinc phosphating solution.

3. A process according to claim 1 wherein the contact is carried out by spraying the metal surface with the aqueous acidic zinc phosphating solution.

4. A process according to claim 1 wherein the contact is carried out by a combination of dipping and spraying with the aqueous acidic zinc phosphating solution.

5. A process according to claim 1 wherein the aqueous acidic zinc phosphating solution also contains from about 0.05 to less than 2 g/l of chlorate ions.

6. A process according to claim 3 wherein the aqueous acidic zinc phosphating solution also contains from about 2 to about 5.0 g/l of chlorate ions.

7. A process according to claim 6 wherein from about 0.4 to about 1.2 g/l of zinc ions are present.

8. A process according to claim 1 wherein the metal surface is selected from the group consisting of an ion-based surface, a zinc-based surface and combinations thereof.

9. A process according to claim 4 wherein the aqueous acidic zinc phosphating solution also contains from about 2 to about 5.0 g/l of chlorate ions.

* * * * *